US010218112B2

(12) United States Patent
Lüttermann et al.

(10) Patent No.: US 10,218,112 B2
(45) Date of Patent: Feb. 26, 2019

(54) ELECTRICAL PLUG CONNECTOR WITH A CABLE FIXING ARRANGEMENT

(71) Applicant: HARTING ELECTRONICS GMBH, Espelkamp (DE)

(72) Inventors: Dieter Lüttermann, Rahden (DE); Uwe Foss, Espelkamp (DE)

(73) Assignee: HARTING Electronics GmbH, Espelkamp (DE)

( * ) Notice: Subject to any disclaimer, the term of this patent is extended or adjusted under 35 U.S.C. 154(b) by 0 days.

(21) Appl. No.: 15/747,743

(22) PCT Filed: Jul. 20, 2016

(86) PCT No.: PCT/DE2016/100327
§ 371 (c)(1),
(2) Date: Jan. 25, 2018

(87) PCT Pub. No.: WO2017/016542
PCT Pub. Date: Feb. 2, 2017

(65) Prior Publication Data

US 2018/0219324 A1 Aug. 2, 2018

(30) Foreign Application Priority Data

Jul. 27, 2015 (DE) ..... 20 2015 103 923 U

(51) Int. Cl.
*H01R 13/58* (2006.01)
*H01R 13/506* (2006.01)

(52) U.S. Cl.
CPC ..... *H01R 13/582* (2013.01); *H01R 13/506* (2013.01)

(58) Field of Classification Search
CPC ..... H01R 13/582; H01R 13/506; H01R 13/4362; H01R 4/2433
(Continued)

(56) References Cited

U.S. PATENT DOCUMENTS 4,443,048 A * 4/1984 Moist, Jr. ..... H01R 43/20 439/599
5,601,447 A * 2/1997 Reed ..... H01R 13/6463 439/404
(Continued)

FOREIGN PATENT DOCUMENTS

DE 14 65 124 B2 5/1975
DE 20 2006 018 019 U1 4/2008
WO 02/15339 A1 2/2002

OTHER PUBLICATIONS

International Search Report and Written Opinion, dated Oct. 11, 2016, for International Application No. PCT/DE2016/100327, 11 pages. (with English Translation of Search Report).

*Primary Examiner* — Hae Moon Hyeon
(74) *Attorney, Agent, or Firm* — Seed IP Law Group LLP

(57) ABSTRACT

An electrical plug connector, comprising an insulating plug connector housing and at least one electrical contact element accommodated in the plug connector housing is provided. The plug connector housing forms a plugging side and a connection side, wherein at least one contact opening extends through the plug connector housing from the plugging side to the connection side. An electrical contact element is accommodated in the contact opening and is fastened and retained in the contact opening. An additional cable fixing arrangement for fastening a connected cable is formed on the connection side of the electrical plug connector.

13 Claims, 2 Drawing Sheets

(58) Field of Classification Search
USPC ..... 439/472, 473, 752.5, 752, 455, 466, 417
See application file for complete search history.

(56) References Cited

U.S. PATENT DOCUMENTS

| | | | | | |
|---|---|---|---|---|---|
| 5,643,009 | A * | 7/1997 | Dinkel | H01R 13/424 | 439/595 |
| 6,176,740 | B1 * | 1/2001 | Abe | H01R 13/4361 | 439/596 |
| 6,273,745 | B1 * | 8/2001 | Yeh | H01R 4/2433 | 439/404 |
| 6,716,056 | B1 * | 4/2004 | Hsu | H01R 4/2429 | 439/406 |
| 6,890,210 | B2 * | 5/2005 | Lee | H01R 4/2433 | 439/397 |
| 6,953,362 | B2 | 10/2005 | Mössner et al. | | |
| 7,934,941 | B2 * | 5/2011 | Hayauchi | H01R 4/2433 | 439/417 |
| 9,343,838 | B2 * | 5/2016 | Jove Albos | H01R 13/504 | |
| 2002/0137403 | A1 * | 9/2002 | Morita | H01R 4/184 | 439/752 |

* cited by examiner

ELECTRICAL PLUG CONNECTOR WITH A CABLE FIXING ARRANGEMENT

BACKGROUND

Technical Field

This disclosure relates to an electrical plug connector comprising an insulating plug connector housing and at least one electrical contact element that is received in the plug connector housing.

Electrical plug connectors of this type are required in order to connect electrical lines or cables to one another in a reversible manner. As a consequence, an electrical contact is to be produced between a first line or a first cable and a second line or a second cable.

Description of the Related Art

The plug connectors that are mostly produced from an insulating base body comprise a plurality of electrical contact elements that can be connected by way of contact openings to the electrical contact elements of a mating plug connector. Depending upon the structural size, various embodiments of electrical plug connectors are known from the prior art. The contact elements are also fixed in the plug connector depending upon the size and the embodiment of the electrical contact elements.

DE 14 65 124 B2 illustrates an electrical plug connector that comprises a housing block having longitudinal channels that are delimited in the insertion direction and contact sleeves that are bent from a stamped part and comprise connection wires that extend in the longitudinal direction can be inserted into said longitudinal channels and latched in a detachable manner behind a shoulder of the longitudinal channel, and said housing block having at the side insertion openings that issue into the contact sleeves and receive the connector pins of a connection plug, having known per se contact sleeves according to a type of groove having a base, which comprises a cutout, and side walls that form the contact surfaces for the connector pin that can be inserted from above in a perpendicular direction towards the base and are connected at the front and the rear by hook-shaped protrusions. By means of a latching tongue that extends from the front end of the cutout rearwards in the direction of the connection wire and is bent outwards with its free end of until it reaches as far as below the connector pin, and by means of a small opening for inserting an extraction tool in the front wall of the housing block in the direction of the latching shoulder of the longitudinal channel, said front wall delimiting the longitudinal channel.

The plug connectors known from the prior art have a disadvantageous effect on the fixing arrangement of the contact elements. Most known plug connectors latch or clamp only the electrical contact element in the insulating body of the plug connector. In this case, an excessively high mechanical loading on a connected cable can produce an adverse effect on the connection between the cable and contact element. In the worst case scenario, the cable can tear away from the electrical contact element and the electrical connection can be disconnected which results in a malfunction of the plug connector.

Although in the case of an embodiment that comprises an additional cable screw connection, the connected cables are in addition mechanically fixed to and retained on the plug connector, said cables do however require a large amount of space. The mechanical connection of the cables to the plug connector requires additional installation space in the connection region of the plug connector. In addition, it is necessary to perform a laborious and complex procedural step when assembling the plug connector.

BRIEF SUMMARY

Embodiments of the present invention provide a plug connector of the above mentioned type that occupies a small installation space and in addition renders it possible to provide an additional mechanical fixing arrangement of the connected cables. It is also possible to perform the assembly procedure in a simple manner, rapidly and without additional aids.

Embodiments of the invention relate to an electrical plug connector that comprises an insulating plug connector housing and at least one electrical contact element that is received in the plug connector housing. The plug connector housing forms a mating side and a connection side that lies opposite the mating side. In addition, at least one contact opening is formed in the plug connector housing. The contact opening extends from the mating side of the plug connector through the plug connector housing as far as the connection side of the plug connector. The plug connector housing simultaneously forms the base body of the electrical plug connector and combines the functions of the insulating contact carrier, housing and latching arrangement.

The at least one contact opening is provided so as to receive an electrical contact element. The contact element latches in the contact opening and is mechanically fixed therein. One advantageous embodiment provides that the contact element latches via a latching lug with a protrusion in the contact opening so that it is not possible to pull the contact element out of the contact opening.

In accordance with embodiments of the invention, the plug connector housing comprises on the connection side a cable fixing arrangement. The cable fixing arrangement is provided so as in addition to fix a cable that is in contact with an electrical contact element to the plug connector. The cable can be a complete multicore cable and also an individual core or strand of a cable. Embodiments of the present invention can be used in both cases. In this respect, both a cable and also a strand are to be understood as the cable.

The cable fixing arrangement is formed from a first fixing element that is formed on the plug connector housing and a second fixing element that cooperates with the first fixing element. The first fixing element can latch as a separate component with the plug connector housing, it can be adhered, screwed, welded or connected thereto in any manner or can be configured as one piece with the plug connector housing.

The second fixing element is configured so that it can latch with the first fixing element that is provided on the plug connector housing. In other words, the second fixing element can be delivered as a separate component and joined to the first fixing element. The second fixing element can however also be retained against the first fixing element and latched therewith by way of a simple assembly procedure.

A guide for guiding the fixing elements towards one another is provided so as to latch the first fixing element with the second fixing element. The guide renders it possible to move the second fixing element in a linear manner towards the first fixing element until it latches therewith. The guide is advantageously oriented in a transverse manner with respect to the at least one contact opening in the plug connector housing. In other words, the guide is likewise oriented in a transverse manner, i.e., perpendicular, with respect to a plug connector axis that extends from the mating side to the connection side of the plug connector.

In one advantageous embodiment, the second fixing element comprises at least one first slot. The first slot is formed as one in the fixing element in such a manner that it is open along the plug connector axis and towards the first fixing element. In other words, the first slot is open from the connection side towards the mating side and ensures access from the direction of the first fixing element. In an expedient manner, multiple first slots are provided adjacent to one another in the second fixing element. Said slots are used to receive cables that are inserted into the plug connector housing.

In addition, at least two webs are provided in the first slots so as to fix cables in the first slots in the second fixing element. The webs that are formed as one on two opposite-lying inner faces of the first slots are oriented in the direction of the first fixing element. In other words, the webs are oriented parallel to one another and in a perpendicular manner with respect to the plug connector axis. The second fixing element can thus grip with a first slot over a cable if said second fixing element is latched with the first fixing element.

One particularly advantageous embodiment provides that the second fixing element comprises a second slot between two first slots respectively. The second slot is provided so as to receive a rib that is formed as one on the first fixing element. The rib that is oriented in the direction of the second fixing element engages in the second slot when the fixing elements are being joined together.

By virtue of an advantageous relation between the strength of the ribs and the second slots, the cables are clamped in the first slots in a particularly advantageous manner. The ribs are dimensioned for this purpose somewhat wider than the second slots. When the first and the second fixing elements are being joined together, the second slots are thus pushed somewhat apart and simultaneously the first slots are pushed together. The cables that are retained in the first slots are thus fixed and retained in an even more improved manner.

Advantageously, embodiments of the present invention provide a plug connector that realizes an additional cable fixing arrangement that requires a very small installation space. The contact elements and cables are assembled by way of latching the fixing elements in a simple manner.

BRIEF DESCRIPTION OF THE SEVERAL VIEWS OF THE DRAWINGS

An exemplary embodiment of the invention is illustrated in the drawings and further explained hereinunder. In the drawings.

DETAILED DESCRIPTION

Figure 1:
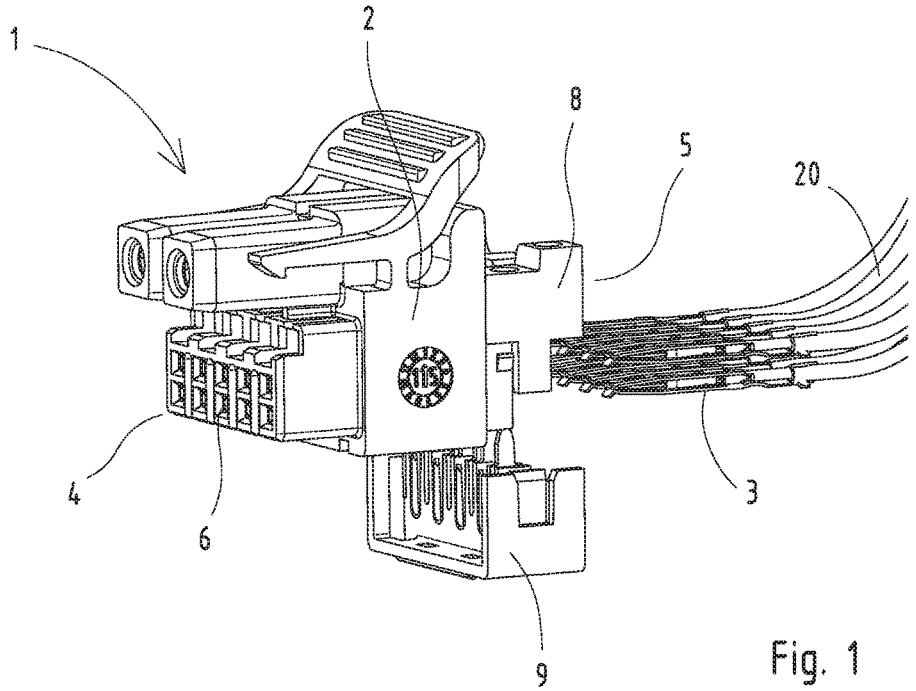
FIG. 1 illustrates a perspective view of a plug connector in accordance with the exemplary embodiment of the invention.

FIG. 1 illustrates a perspective view of an electrical plug connector 1 in accordance with an exemplary embodiment of the invention. The electrical plug connector 1 is formed from a plug connector housing 2 that in this exemplary embodiment comprises ten contact openings 6.

The contact openings 6 extend through the plug connector housing 2 along a plug connector axis from a mating side 4, illustrated on the left-hand side, as far as a connection side 5, illustrated on the right-hand side. In addition to the ten contact openings 6 for signal contacts, the specific illustrated exemplary embodiment comprises also two openings for power contacts, said two openings being arranged above said contact openings 6.

The contact openings 6 are provided so as to receive in each case an electrical contact element 3. The electrical contact elements 3 can be inserted from the connection side 5 into the contact openings 6 and latched therein. The electrical contact elements 3 are mechanically fixed in the plug connector housing 2 as a result of the latching arrangement in the contact openings 6.

A cable 20 is provided in each case on the electrical contact elements 3. The cables 20 are fastened to the electrical contact elements 3 by way of a respective crimped region. In order to avoid a mechanical overloading of the crimped connection, a cable fixing arrangement is also provided on the connection side 5 of the plug connector 1.

The cable fixing arrangement is formed from a first fixing element 8 and a second fixing element 9. The first fixing element 8 is provided on the connection side 5 of the plug connector 1 and is configured as one part with the plug connector housing 2. A two-part embodiment is also conceivable in this case. The second fixing element 9 is a separate component and is illustrated below the first fixing element 8. The first fixing element 8 and the second fixing element 9 can be joined together so as to fix the cables 20 and can be latched with one another.

Figure 2:
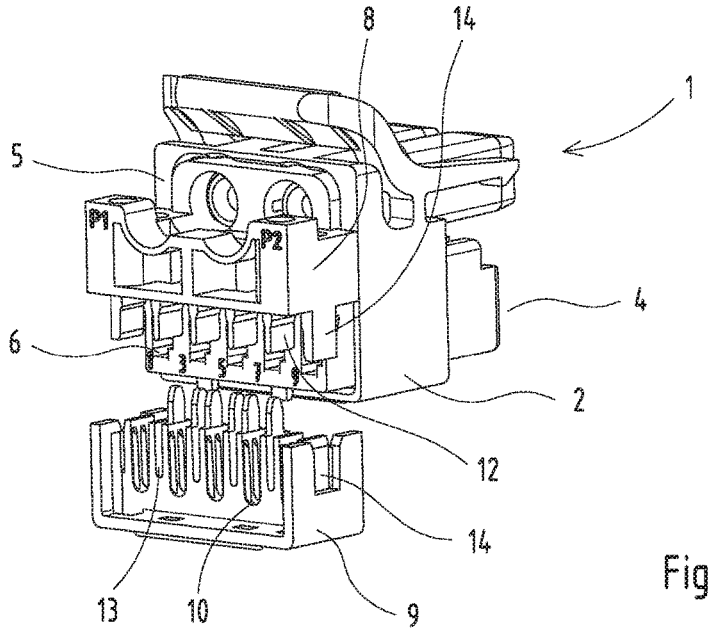
FIG. 2 illustrates a further perspective view of the plug connector in accordance with the exemplary embodiment of the invention.

FIG. 2 illustrates a further perspective view of the electrical plug connector 1 in accordance with the exemplary embodiment of the invention shown in FIG. 1. In this illustration, the plug connector 1 is illustrated with a view of the connection side 5. The first fixing element 8 is provided on the connection side 5 as one piece with the plug connector housing 2.

The second fixing element 9 is arranged below the first fixing element 8. The two fixing elements 8, 9 comprise guides 14 at the side. The guides 14 render it possible to guide the fixing elements 8, 9 in a linear manner towards one another. The second fixing element 9 can thus be pushed onto the first fixing element 8 and latched thereto.

In accordance with exemplary embodiment of the invention, the second guiding element 9 comprises multiple—in this case five—first slots 10. The first slots are configured so as to be open along their plug connector shaft and towards the first fixing element 8. This renders it possible for the cables 20 to be inserted into the first slots 10 as the first fixing element 8 is being joined to the second fixing element 9.

In order to ensure that the cables 20 are mechanically fixed in the first slots 10, webs 11 (FIGS. 3 and 4) are formed in addition on the inner faces of the first slots 10. The webs 11 are configured so as to mechanically clamp a cable 10 that has been inserted. The webs 11 are described in detail in FIG. 4.

Figure 3:
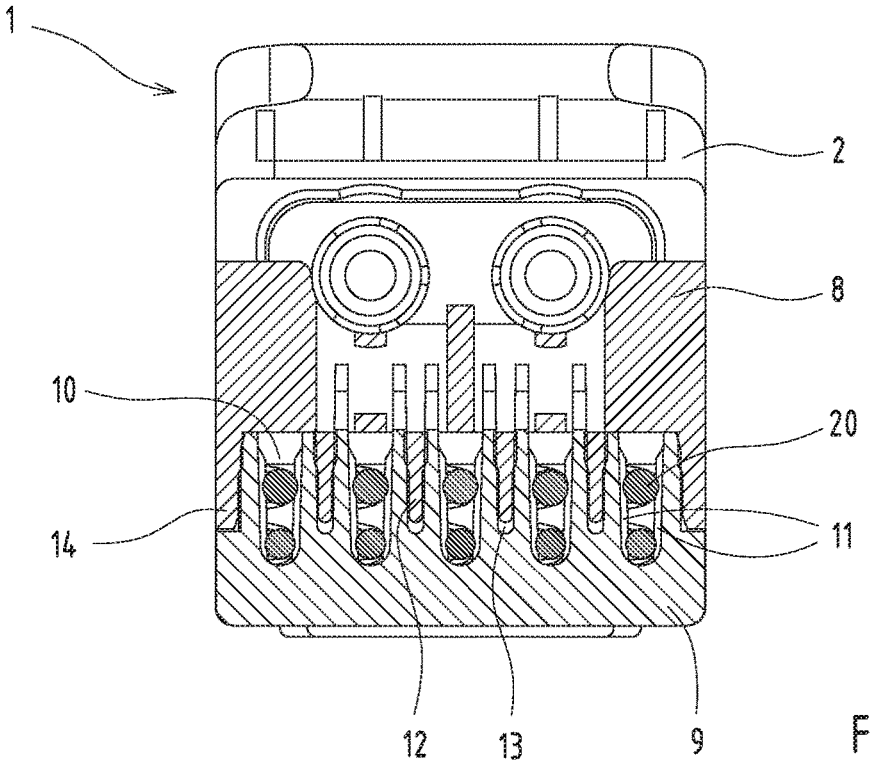
FIG. 3 illustrates a sectional view of the plug connector in accordance with the exemplary embodiment of the invention.

A cross-section through an electrical plug connector 1 in accordance with the exemplary embodiment of the invention is illustrated in FIG. 3. In contrast to the FIGS. 1 and 2, the cable fixing arrangement, which is formed from the first fixing element 8 and the second fixing element 9, is completely assembled. The guides 14 of the first and second fixing elements 8, 9 engage completely in one another.

Each of the first slots 10 receives two cables 20 one above the other. The second fixing element 9 comprises between two first slots 10 respectively a further second slot 13 respectively. A rib 12 of the first fixing element 8 is received in each case in the second slots 13. In addition to additionally guiding the first fixing element 8 and the second fixing element 9 towards one another, the second slots 13 are used in conjunction with the ribs 12 so as to additionally fix the cables 20 and also to reinforce the second fixing element 9.

The ribs 12 are dimensioned somewhat wider that the second slots 13. As a consequence, the second slots 13 become somewhat wider when the two fixing elements 8,9 are being joined together. The first slots 10 are simultaneously somewhat pressed together as a result. In turn, this results in the cables 20 that are received in the first slots 10 being more firmly clamped.

Figure 4:
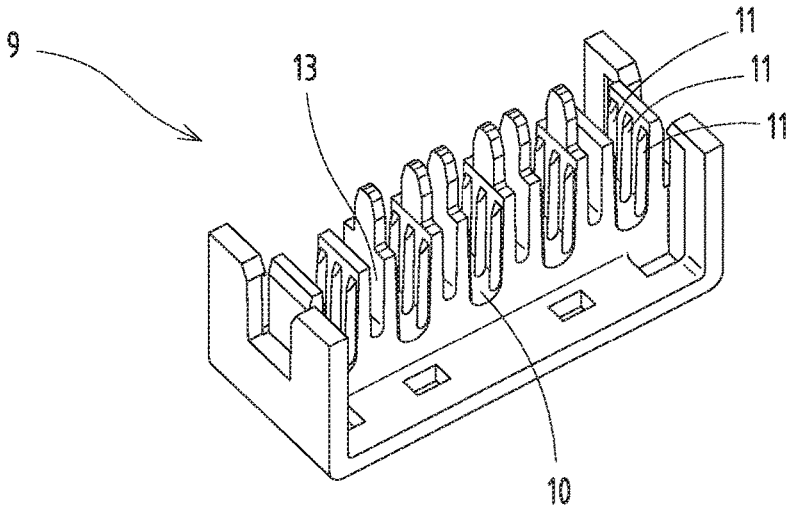
FIG. 4 illustrates a perspective view of an isolated second fixing element of the plug connector.

An isolated second fixing element 9 is illustrated in a perspective view in FIG. 4. Five first slots 10 are arranged adjacent to one another, wherein a second slot 13 is provided between two first slots 10 respectively.

The webs 11 are particularly easily evident. These webs 11 are provided on the inner face of the first slots 10. In this exemplary embodiment, three webs 11 are arranged in each case parallel to one another. The webs 11 are oriented in a perpendicular manner with respect to the plug connector axis with the result that as the second fixing element 9 and the first fixing element 8 are being joined together, the cables 20 can slide along the webs 11 into the first slots 10. By virtue of orienting the webs 11 in a perpendicular manner with respect to the plug connector axis, it is not possible to pull the cables 20 along the plug connector axis out of the cable fixing arrangement and the plug connector 1.

As a result, an electrical plug connector 1 with an additional cable fixing arrangement is thus realized in a particularly advantageous manner in a very small installation space. The assembly procedure can be performed by way of a simple hand grip without the use of a further tool.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An electrical plug connector, comprising:

an insulating plug connector housing; and at least one electrical contact element that is received in the plug connector housing, wherein the plug connector housing forms a mating side and a connection side, wherein at least one contact opening is formed in the plug connector housing, said contact opening extending from the mating side through the plug connector housing as far as the connection side, wherein the electrical contact element is received in the contact opening and is fixed therein, wherein the plug connector housing comprises a cable fixing arrangement on the connection side, wherein the cable fixing arrangement is formed from a first fixing element, which is formed as one on the plug connector housing, and a second fixing element that cooperates with the first fixing element, wherein the first fixing element and the second fixing element can latch with one another by way of a guide in a linear manner transverse with respect to the at least one contact opening, wherein the second fixing element comprises at least one first slot, wherein the first slot has an inner face and is open towards the first fixing element, and wherein the first slot comprises at least two webs on the inner face, wherein the webs are oriented parallel, in the direction of the open side, towards the first fixing element.

2. The electrical plug connector as claimed in claim 1, wherein at least one rib is formed on the first fixing element, wherein the at least one rib is oriented in the direction of the second fixing element.

3. An electrical plug connector, comprising:

an insulating plug connector housing; and at least one electrical contact element that is received in the plug connector housing, wherein the plug connector housing forms a mating side and a connection side, wherein at least one contact opening is formed in the plug connector housing, said contact opening extending from the mating side through the plug connector housing as far as the connection side, wherein the electrical contact element is received in the contact opening and is fixed therein, wherein the plug connector housing comprises a cable fixing arrangement on the connection side, wherein the cable fixing arrangement is formed from a first fixing element, which is formed as one on the plug connector housing, and a second fixing element that cooperates with the first fixing element, wherein the first fixing element and the second fixing element can latch with one another by way of a guide in a linear manner transverse with respect to the at least one contact opening, wherein the second fixing element comprises at least one first slot, wherein the first slot is open towards the first fixing element, wherein at least one rib is formed on the first fixing element, wherein the at least one rib is oriented in the direction of the second fixing element, and wherein at least one second slot is formed on the second fixing element, and wherein the at least one rib of the first fixing element can be inserted into the second slot.

4. The electrical plug connector as claimed in claim 3, wherein the at least one second slot of the second fixing element is arranged between two first slots.

5. The electrical plug connector as claimed in claim 4, wherein the at least one rib is dimensioned wider than the at least one second slot with the result that the at least one second slot forms a press-fit together with the at least one rib that is received in said second slot.

6. An electrical plug connector, comprising:

an insulating plug connector housing having a mating side and a connection side, and including one or more contact openings extending in a connection direction from the mating side to the connection side;

one or more electrical contact elements each received and fixed in a respective one of the contact openings of the plug connector housing; and a fixing element of a cable fixing arrangement that cooperates with the insulating plug connector housing to assist in fixing each of the one or more electrical contact elements in the respective contact opening, wherein the fixing element and the insulating plug connector housing are configured to latch together in a latching direction transverse to the connection direction, and wherein the fixing element comprises one or more cable receiving slots each open toward the insulating plug connector housing, each cable receiving slot including at least two webs on an inner face thereof that are oriented parallel to the latching direction.

7. The electrical plug connector as claimed in claim 6, wherein at least one rib is formed on the insulating plug connector housing and oriented in the direction of the fixing element, and wherein at least one rib receiving slot is formed on the fixing element to insertably receive the at least one rib of the insulating plug connector housing.

8. The electrical plug connector as claimed in claim 7, wherein the at least one rib receiving slot is arranged between two cable receiving slots.

9. The electrical plug connector as claimed in claim 7, wherein the at least one rib of the insulating plug connector housing is dimensioned wider than the at least one rib receiving slot with the result that the at least one rib receiving slot forms a press-fit together with the at least one rib that is received therein.

10. An electrical plug connector, comprising:

an insulating plug connector housing having a mating side and a connection side, and including one or more contact openings extending in a connection direction from the mating side to the connection side;

one or more electrical contact elements each received and fixed in a respective one of the contact openings of the plug connector housing; and a fixing element of a cable fixing arrangement that cooperates with the insulating plug connector housing to assist in fixing each of the one or more electrical contact elements in the respective contact opening, wherein the fixing element and the insulating plug connector housing are configured to latch together in a latching direction transverse to the connection direction, and wherein at least one rib is formed on the insulating plug connector housing and oriented in the direction of the fixing element, and wherein at least one rib receiving slot is formed on the fixing element to insertably receive the at least one rib of the insulating plug connector housing.

11. The electrical plug connector as claimed in claim 10, wherein the fixing element comprises one or more cable receiving slots each open toward the insulating plug connector housing, each cable receiving slot including at least two webs on an inner face thereof that are oriented parallel to the latching direction.

12. The electrical plug connector as claimed in claim 11, wherein the at least one rib receiving slot of the fixing element is arranged between two cable receiving slots.

13. The electrical plug connector as claimed in claim 10, wherein the at least one rib of the insulating plug connector housing is dimensioned wider than the at least one rib receiving slot with the result that the at least one rib receiving slot forms a press-fit together with the at least one rib that is received therein.

* * * * *